US011291605B2

(12) United States Patent
Gomez

(10) Patent No.: US 11,291,605 B2
(45) Date of Patent: Apr. 5, 2022

(54) ILLUMINATED WHITE CANE

(71) Applicant: Frank Gomez, Pinion Hills, CA (US)

(72) Inventor: Frank Gomez, Pinion Hills, CA (US)

( * ) Notice: Subject to any disclaimer, the term of this patent is extended or adjusted under 35 U.S.C. 154(b) by 0 days.

(21) Appl. No.: 17/363,247

(22) Filed: Jun. 30, 2021

(65) Prior Publication Data

US 2021/0401661 A1 Dec. 30, 2021

Related U.S. Application Data

(60) Provisional application No. 63/046,522, filed on Jun. 30, 2020.

(51) Int. Cl.

| | |
|---|---|
| ***A61H 3/06*** | (2006.01) |
| ***F21V 3/02*** | (2006.01) |
| ***F21S 9/02*** | (2006.01) |
| ***F21V 23/00*** | (2015.01) |
| ***A45B 9/00*** | (2006.01) |
| ***F21V 23/06*** | (2006.01) |
| ***F21V 23/04*** | (2006.01) |

(52) U.S. Cl.

CPC ..... *A61H 3/068* (2013.01); *F21S 9/02* (2013.01); *F21V 3/02* (2013.01); *F21V 23/003* (2013.01); *F21V 23/04* (2013.01); *F21V 23/06* (2013.01); *A45B 2009/002* (2013.01); *A45B 2009/007* (2013.01); *A61H 2201/0161* (2013.01); *A61H 2201/0188* (2013.01)

(58) Field of Classification Search

CPC ..... A61H 3/068; A61H 2201/0161; A61H 2201/0188; F21S 9/02; F21V 3/02; F21V 23/04; F21V 23/06

See application file for complete search history.

(56) References Cited

U.S. PATENT DOCUMENTS

| | | | |
|---|---|---|---|
| 2,642,519 | A | 6/1949 | William |
| 6,394,116 | B1 | 5/2002 | Winn |
| 2004/0264172 | A1 | 12/2004 | Roberts |

FOREIGN PATENT DOCUMENTS

| | | | | | |
|---|---|---|---|---|---|
| CN | 111150193 | A | * | 5/2020 | |
| KR | 20200027893 | A | * | 3/2020 | ..... A45B 9/00 |
| WO | WO-2012136228 | A1 | * | 10/2012 | ..... A45B 3/12 |

* cited by examiner

*Primary Examiner* — Anabel Ton
(74) *Attorney, Agent, or Firm* — Michael C. Balaguy

(57) ABSTRACT

An illuminated white cane is disclosed herein. The white cane has two translucent tubular sections which may contain a flexible illumination circuit. Each tubular section may have a red portion and a white portion, through which the illuminator circuit is able to transmit light. An elastic cord may pass through the two sections in parallel to the illuminator circuit, being anchored to a handle and handle core at one end, and a cane-tip bushing with a threaded retainer at the other end. The two tubular sections join with two bushings that are retained together by the tension of the elastic cord.

6 Claims, 5 Drawing Sheets

ILLUMINATED WHITE CANE

CROSS-REFERENCE TO RELATED APPLICATION(S)

The present application is related to and claims priority to U.S. Provisional Patent Application No. 63/046,522 filed Jun. 30, 2020, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of mobility devices of existing art and more specifically relates to walking canes for the visually impaired.

RELATED ART

Individuals fully or partially lacking sight often rely on tactile means to perceive and interact with the world around them. A significant way that this may be accomplished is by use of a walking cane. By reaching out in front while walking, a user may feel out the terrain before them using the walking cane.

Nonetheless, vision-impaired users walking with a walking staff in this way still experience challenges. In particular, bystanders may not immediately comprehend that the user is vision-impaired, and may impede or confuse the user. Accordingly, it is useful to advertise to bystanders that the user is vision-impaired. To this end, many walking canes are colored white, and known as "white canes". Even so, this might not sufficiently indicate to others that the user is vision-impaired. Since the white cane has remained limited in its development and usefulness over the last century, there is perceived a need to develop a white cane that better advertises vision impairment and also incorporates auxiliary functions.

U.S. Pub. No. 2004/0264172 to Hess Roberts relates to an illuminated cane. The described illuminated cane includes an illuminated cane having a shaft arranged between a handle and lower end cap, whereby the shaft may be solid or tubular formed, having a light source provided therein, and which light source may be permanently illuminated, by depressing of a button, or ignition switch, to illuminate the light and light the entire height of the shaft for the cane, or the light may be turned on either by depressing a switch in the vicinity of the hand grip or actuating a push button at the bottom of the cane, as when the cane is rested upon the surface of the ground. Or, a flasher may be included within the structure of the light source, which may include a battery, spring, ignition switch, or even a flasher, to provide for either permanent, temporary, or blinking lighting, along the height of the cane shaft.

SUMMARY OF THE INVENTION

In view of the foregoing disadvantages inherent in the known white cane art, the present disclosure provides a novel illuminated white cane. The general purpose of the present disclosure, which will be described subsequently in greater detail, is to provide an illuminated white cane providing greater visibility and recognizability to bystanders.

An illuminated white cane is disclosed herein. The white cane has two translucent tubular sections which may contain a flexible illumination circuit. Each tubular section may have a red portion and a white portion, through which the illuminator circuit is able to transmit light. An elastic cord may pass through the two sections in parallel to the illuminator circuit, being anchored to a handle and handle core at one end, and a cane-tip bushing with a threaded retainer at the other end. The two tubular sections join with two bushings that are retained together by the tension of the elastic cord.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an illuminated white cane, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a white cane and more particularly to an illuminated white cane as used to improve the visibility and recognizability of visually-impaired users.

Generally, the illuminated white cane is a thin rigid walking stick useful for assisting visually-impaired individuals with interacting and feeling their surroundings. However, the illuminated walking cane incorporates a number of features which improve the usability of the white cane, and in particular, improve the recognizability of the white cane to bystanders.

In construction, the illuminated white cane may be composed of one more more tubular members which form the external shape of the white cane, and may house the internal mechanisms of the white cane. In a preferred embodiment, the white can include two tubular sections which may be joined together end-to-end in use, or may be detached and folded together for compact storage. In some embodiments, an elastic cord may join the two tubular sections together when they are detached, being concealed within the internal bores when joined.

Within the internal bores may be an electrical circuit powering a plurality of illuminators, such as a light-emitting diode (L.E.D.) array. The tubular sections may be sufficiently transparent to enable the illuminators to be visible from outside of the bores when energized. Importantly, the tubular sections include white portions (as is traditional for white canes), and also red portions. This contrast and the recognizability of these colors are important for the use of the white cane as a visual impairment assisting device in public spaces.

One of the tubular sections may be directly affixed to a handle assembly. The handle itself may contain an activation button (or on/off switch) able to energize the illuminator circuit. Preferably, the device is self-powered by a contained battery. This battery may be contained in the handle or in one of the tubular sections. The illuminator circuit may be powered by direct current, having positive and negative supply wires, and may include light-emitting diodes placed in series along the length of the two cane sections.

Various electronic features may be implemented. A controller may be able to toggle the illumination on and off with a mechanical switch, or may be able to offer other illumination features, such as strobing, various dimness settings, etc. A single toggle switch may be provided on the handle, or a radio-button type switch, or other mechanical switch types. In some embodiments, audio playback features may be integrated with the cane, such as a Bluetooth audio player, or input jacks in combination with a speaker. Audible alerts for low battery status and other notifications may be programmed into the controller.

Referring now more specifically to the drawings by numerals of reference, there is shown in FIGS. 1-5, various views of a cane assembly 100.

Figure 1:
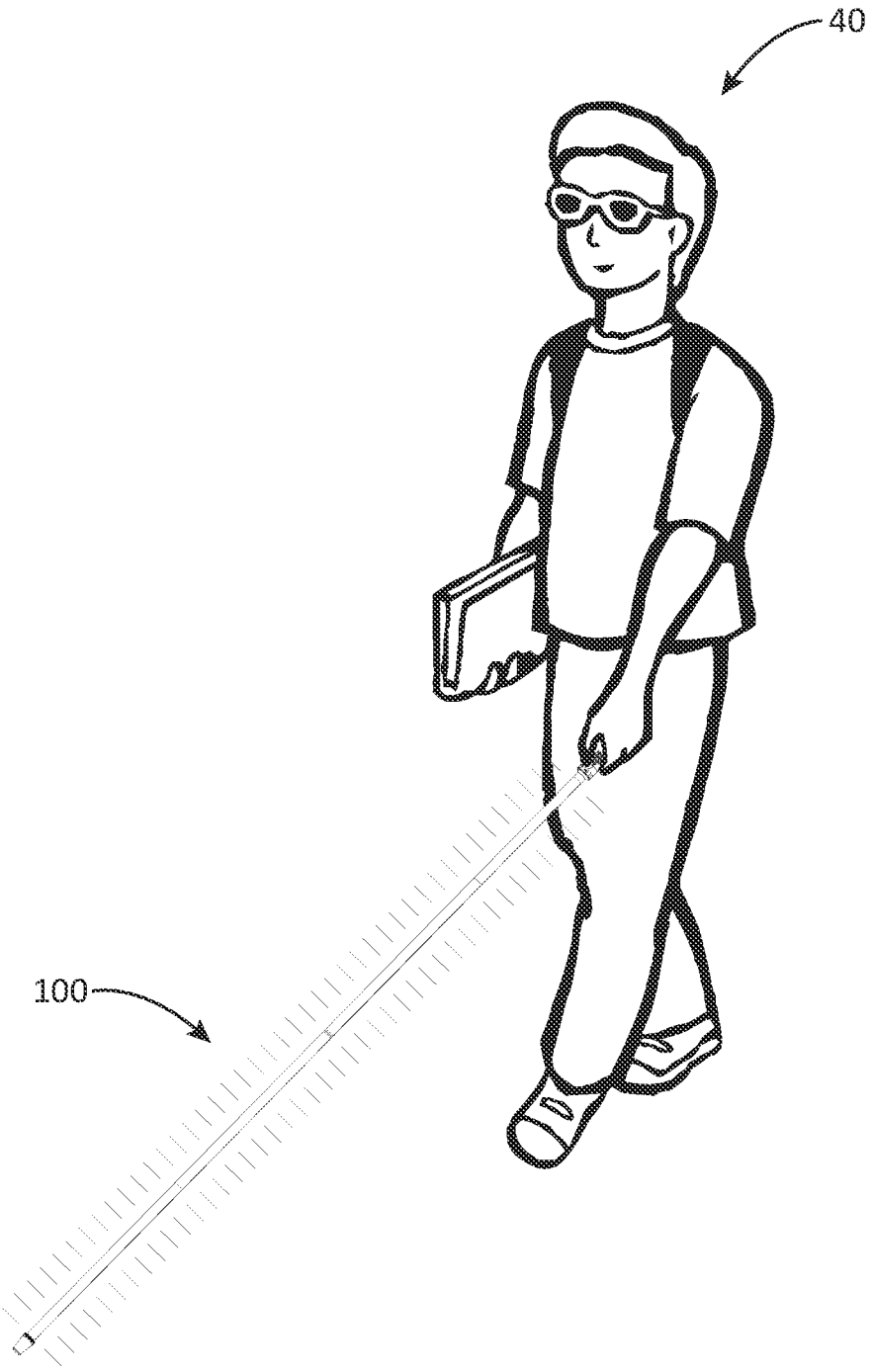
FIG. 1 is a perspective view of the illuminated white cane during an 'in-use' condition, according to an embodiment of the disclosure.

FIG. 1 shows a cane assembly during an 'in-use' condition, according to an embodiment of the present disclosure. Here, the cane assembly may be beneficial for use by a user 40 to improve the visibility and recognizability of a visually impaired user. As illustrated, the cane assembly 100 may be used by user 40 in the traditional manner of a white cane, giving tactile feedback to the user of the landscape in from of him or her.

Figure 2:
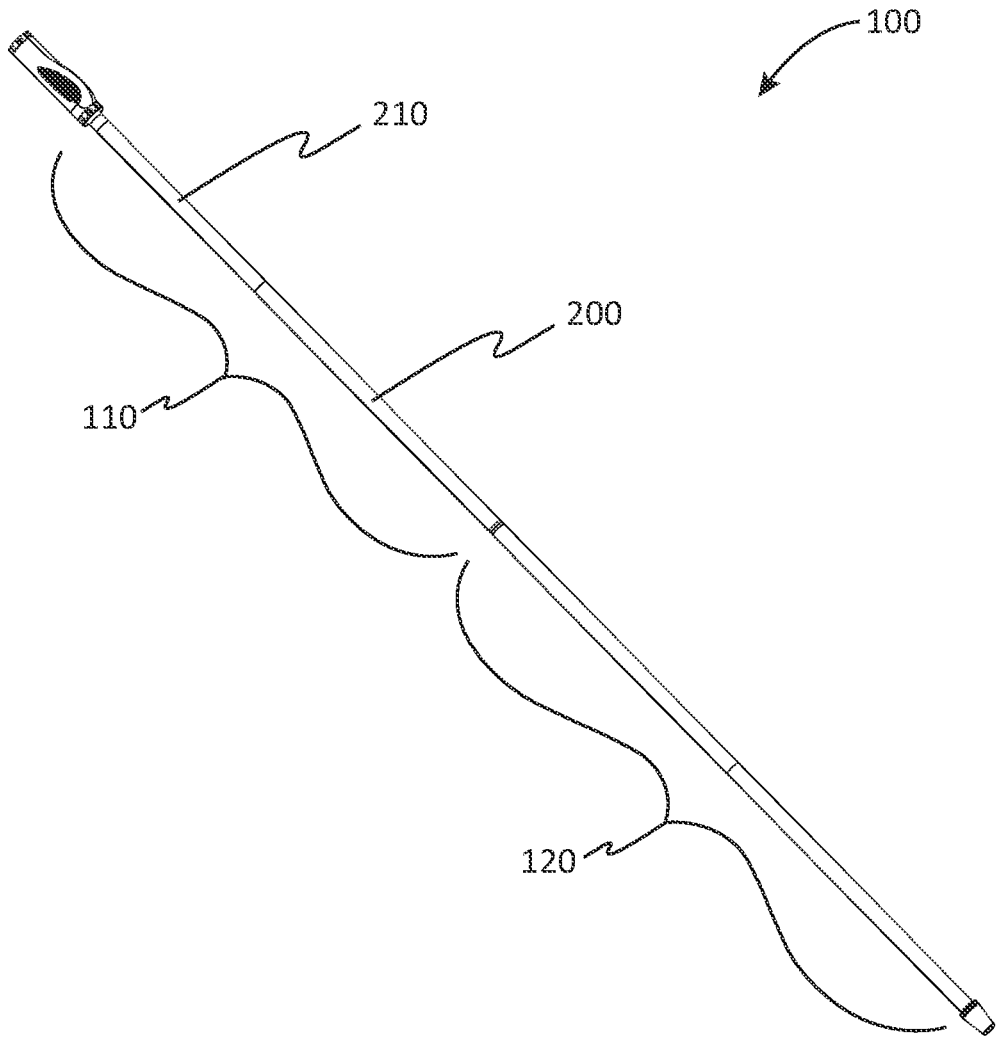
FIG. 2 is a perspective view of the cane assembly 100 of FIG. 1, according to an embodiment of the present disclosure.

FIG. 2 is a perspective view of the cane assembly 100 of FIG. 1, according to an embodiment of the present disclosure. As shown, each of first-polymer tube 112 (FIG. 5A) of first-cane member 110 and second-polymer tube 122 (FIG. 5A) of second-cane member 110 have red-colored section 200 and white-colored section 210. Each of red-colored section 200 and white-colored section 210 should make up no less than twenty-five percent of the external surface area of either cane section. While white has traditionally been the accepted color of white canes, the addition of red bands increases the visibility and recognizability of the cane in public use. Red-colored section 200 and white-colored section 210 may be formed by the application of translucent decals upon first-cane member 110 and second-cane member 120. However, other coloring methods may be implemented.

Figure 3:
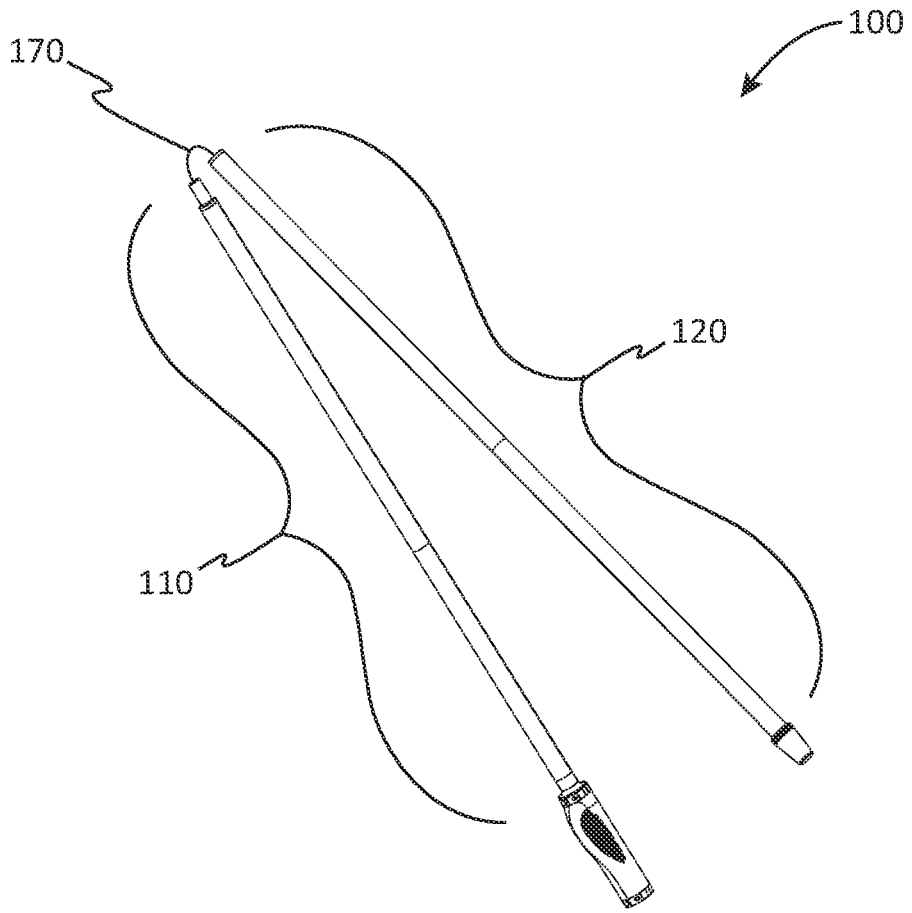
FIG. 3 is a perspective view of the cane assembly 100 of FIG. 1, according to an embodiment of the present disclosure.

FIG. 3 is a perspective view of the cane assembly 100 of FIG. 1, according to an embodiment of the present disclosure. As shown, first-cane member 110 and second-cane member 120 may be separated into two components, roughly equal in length, for convenient carry or storage. Elastic cord 170 retains them together when mechanically interfaced by providing tension. When first-cane member 110 and second-cane member 120 are pulled apart and separated, elastic cord 170 still remains attached to each internally, preventing first-cane member 110 and second-cane member 120 from being lost from one another.

Figure 4:
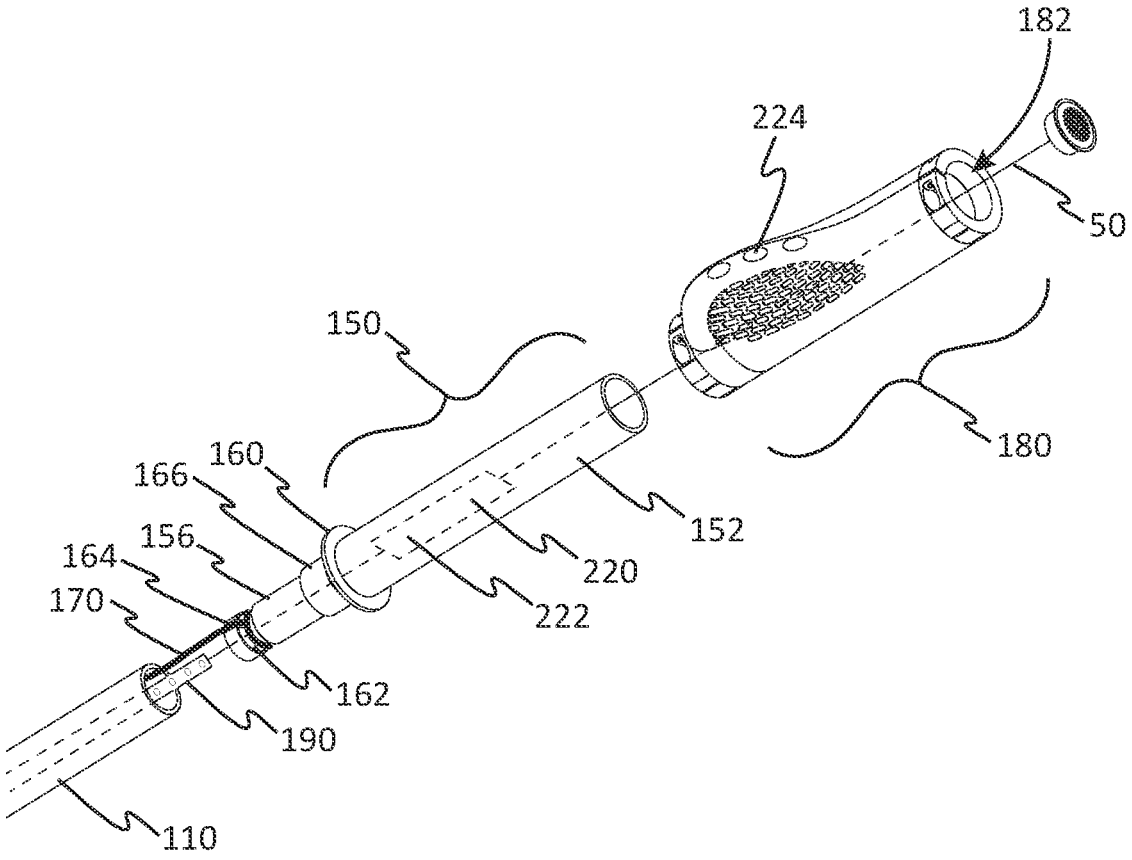
FIG. 4 is an exploded view of the handle area of cane assembly 100 of FIG. 1, according to an embodiment of the present disclosure.

FIG. 4 is an exploded view of the handle area of cane assembly 100 of FIG. 1, according to an embodiment of the present disclosure. Handle-core 150 may include cylindrical-shaft 152, bushing-shaft 154, flange 160, annular channel 162, and slot 164. Preferably, each of these subcomponents are unitary to handle-core 150. Handle-core 150 may be machined from aluminum or another metal, or may be injected-molded plastic, or another unitary component. Bushing-shaft 154 may be smaller in diameter than the inside of first-polymer tube 112. Bushing-shaft 154 may terminate in core-end 156, which itself is insertable into first-polymer tube 112. Flange 160 may be between and may divide cylindrical-shaft 152 and bushing-shaft 154, providing a surface for handle-shell 180 to impinge upon, and forming a hand-stop for the user's hand when gripping handle-shell 180. Annular channel 162 relieves (is cut into) bushing-shaft 154, and is connected with slot 164, slot 164 also being relieved into bushing-shaft 154. Slot 164 interrupts (passes out the end of) core-end 156. Slot 164 may be within ten degrees of parallel with an axis 50 of cylindrical-shaft 152; preferably it is completely parallel. Step 166 is disposed between flange 160 and annular channel 162 as shown.

The combination of annular channel 162 and slot 164 act as a retainer for elastic cord 170. Elastic cord 170 is assembled to join second-polymer tube 122 to handle-core 150. Elastic cord 170 is looped about annular channel 162 and passed through slot 164 during assembly, such that when bushing-shaft 154 is inserted into first-polymer tube 112, elastic cord 170 is prevented from leaving annular channel 162, as first-polymer tube 112 is snug about bushing-shaft 154 and elastic cord 170 is only able to fit through core-end 156 in the relieved gap formed by slot 164, and one end of elastic cord 170 (elastic cord 170 being a single loop of material) is looped around bushing-shaft 154 in annular channel 162.

Handle-shell 180 may include bore 182, which is itself able to interface with, surround, and envelop handle-core 150. The assembly may also include power source 220, and controller 222, and power switch 224. Each of power source 220, controller 222, and power switch 224 may be housed in handle-core 150 and may be electrically connected with electric illuminator circuit 190. Preferably, the power source 220 is a battery, such as a rechargeable lithium battery, enabling the circuit to be powered in mobile use.

Figure 5A:
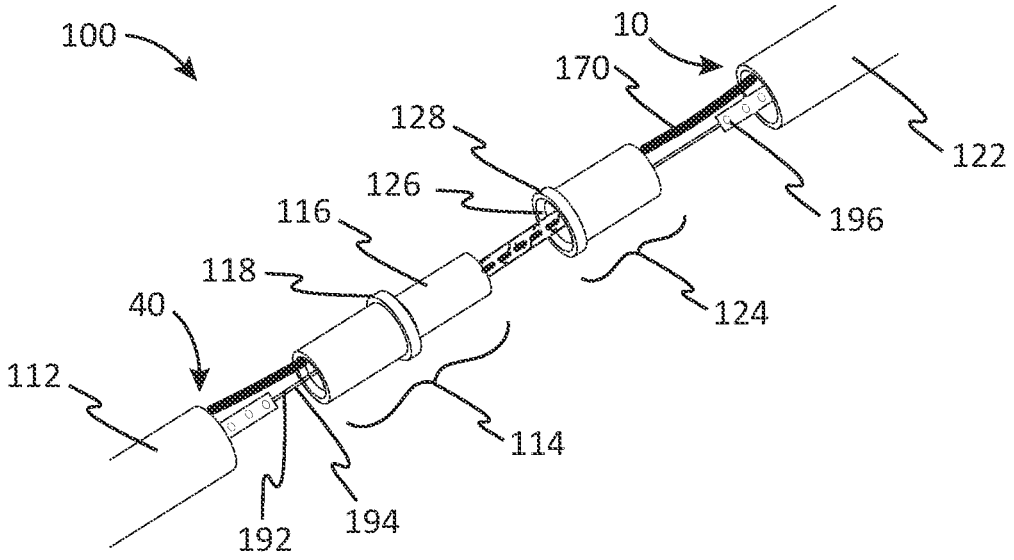
FIG. 5A is an exploded view of the interface of the two cane members of cane assembly 100 of FIG. 1, according to an embodiment of the present disclosure.

FIG. 5A is an exploded view of the interface of the two cane members of cane assembly 100 of FIG. 1, according to an embodiment of the present disclosure. Walking cane 100 may include first-cane member 110 and second-cane member 120. First-cane member 110 may itself include first-polymer tube 112 forming the external structure and geometry of first-cane member 110, and first-bushing 114. First-bushing 114 during assembly may be inserted into first-polymer tube 112 and may include male-cylindrical interface 116 disposed at distal terminus 10 of first-cane member 110. First-bushing 114 may be externally cylindrical and may include first-collar 118, such that first-collar 118 may be able to rest upon an end of first-polymer tube 112 and sit externally flush with the first-polymer tube 112. Second-cane member 120 may itself include second-polymer tube 122 forming the external structure and geometry of second-cane member 110, and second-bushing 124. Second-bushing 124 may be inserted into second-polymer tube 122 during assembly. Second-bushing 124 may include female-bore interface 126 disposed at proximal terminus 40 of second-cane member 120 and may be able to mechanically connect to the male-cylindrical interface 116. Second-bushing 124 may be externally cylindrical and may include second-collar 128, which may be able to rest upon an end of second-polymer tube 122. Second-collar 128 may be externally flush with second-polymer tube 122 when assembled. First-bushing 114 and second-bushing 124 may be affixed to first-polymer tube 112 and second-polymer tube 122 respectively by bonding or another adhesive means.

Electric illuminator circuit 190 may be passed through each of first-polymer tube 112 and second-polymer tube 122. Electric illuminator circuit 190 may be made up of at least flexible positive conduit 192, at least one flexible negative conduit 194, and plurality of light elements 196, which are to be supplied with direct current by the combination of at least one flexible positive conduit 192 and at least one flexible negative conduit 194. In like fashion, elastic cord 170 may be passed internally through each of first-polymer tube 112 and second-polymer tube 122. Each of first-polymer tube 112 and second-polymer tube 122 may be translucent to permit light to pass from the light elements 196 outwardly from the cane assembly 100.

Figure 5B:
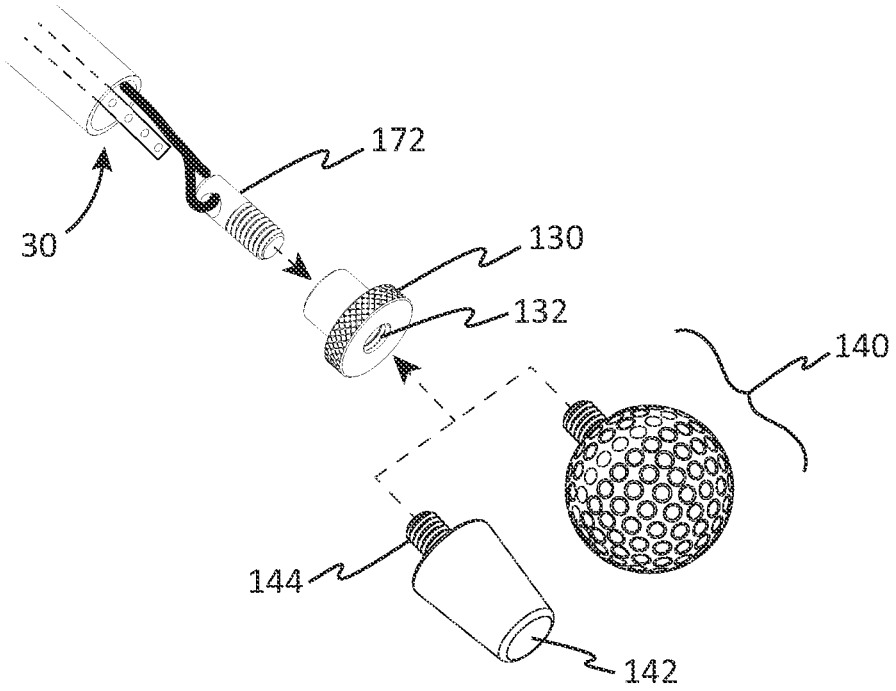
FIG. 5B is an exploded view of the tip area of the cane assembly 100 of FIG. 1, according to an embodiment of the present disclosure.

FIG. 5B is an exploded view of the tip area of the cane assembly 100 of FIG. 1, according to an embodiment of the present disclosure. Tip-bushing 130 may be disposed at distal terminus 30 of second-cane member 120 and may have threaded bore 132. Cane-tip 140 may have contact surface 142 and threaded stud 144. Threaded stud 144 may be able to threadably interface with threaded bore 132. In this way, cane-tip may be able to be releasably affixed to tip-bushing 130, and different cane tips may be able to be interchanged at the desirability of the user. During assembly, tip-bushing 130 may be bonded or otherwise adhered to second-cane member 120.

Cord retainer 172 may provide a fastening point for tip-bushing 130 in some embodiments through use of a threaded shaft. Cord retainer 172 may affix to elastic cord 170 (FIG. 4), through use of an aperture, a clip, or other means. Accordingly, it is through elastic cord 170 (FIG. 4) tensioning handle-core 150 to cord-retainer 172, and thereby sandwiching first-cane member 110 and second-cane member 120 in between, that can assembly 100 may be held together. In some embodiments, bore 132 may be threaded all the way through, not being a blind bore, and can accept threaded fasteners at both ends (i.e., cord retainer 172 and threaded stud 144). Various versions of cane-tip 140 may be implemented, in various geometries and ornamental designs. Illustrated are a truncated conical tip and a golf-ball design tip. Various materials may be implemented. For example, contact-surface 142 may be rubber lined for better grip.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A walking cane comprising:

a first-cane member having a first-polymer tube, and a first-bushing inserted into said first-polymer tube, said first-bushing including a male-cylindrical interface disposed at a distal terminus of said first-cane member, said first-bushing being externally cylindrical, said first-bushing further including a first-collar able to rest upon an end of said first-polymer tube, said first-collar being externally flush with said polymer first-polymer tube;

a second-cane member having a second-polymer tube, a second-bushing inserted into said second-polymer tube, said second-bushing including a female-bore interface disposed at a proximal terminus of said second-cane member, said female-bore interface being able to mechanically connect to said male-cylindrical interface, said second-bushing being externally cylindrical, said second-bushing further including a second-collar able to rest upon an end of said second-polymer tube, said second-collar being externally flush with said polymer second-polymer tube, and a tip-bushing disposed at a distal terminus of said second-cane member, the tip-bushing having a threaded-bore;

a cane-tip having a contact-surface, and a threaded-stud able to threadably interface with said threaded-bore;

a handle-core including a cylindrical-shaft, a bushing-shaft which is diametrically smaller than an inside of the first-polymer tube, said bushing-shaft having a core-end which is insertable into said first-polymer tube, a flange dividing said cylindrical-shaft and said bushing-shaft, an annular channel relieving said bushing-shaft, a slot relieving said bushing-shaft, connecting with said annular channel and interrupting said core-end, and a step between said flange and said annular channel;

an elastic cord formed in a single loop and joining said second-polymer tube to said handle-core, said elastic cord being looped about said annular channel and passed through said slot, such that when said bushing-shaft is inserted into said first-polymer tube, said elastic cord is prevented from leaving said annular channel;

a handle-shell including a bore able to interface with said handle-core; and an electric illuminator circuit passing through each of said first-polymer tube and said second-polymer tube, said electric illuminator circuit comprising at least one flexible positive conduit, at least one flexible negative conduit, and a plurality of light elements supplied with direct current by said combination of the at least one flexible positive conduit and said at least one flexible negative conduit, passing interiorly through said first-cane member and said second-cane member.

2. The walking cane of claim 1, wherein each of said first-polymer tube and said second-polymer tube exteriorly comprise a red-colored section and a white-colored section, each of said red-colored section and said white-colored section comprising no less than twenty-five percent of an external surface area of each of said first-polymer tube and said second-polymer tube.

3. The walking cane of claim 1, wherein said slot is within ten degrees of parallel with an axis of said cylindrical-shaft.

4. The walking cane of claim 1, wherein each of said first-polymer tube and said second-polymer tube are translucent.

5. The walking cane of claim 1, further comprising a power source, and a controller, and a power switch, each of said power source, said controller, and said power switch being housed in said handle-core and electrically connected with said electric illuminator circuit.

6. The walking cane of claim 1, further comprising a cord-retainer including a threaded-shaft able to threadably interface with said threaded-bore of said tip-bushing; and an eyelet able to accept said elastic-cord;

wherein said threaded-bore is able to accept said threaded-shaft of said cord-retainer and said threaded-stud of said cane-tip simultaneously; and wherein said cord-retainer is a single unitary component.

* * * * *